United States Patent [19]

Schoker

[11] 4,231,134

[45] Nov. 4, 1980

[54] AUTOMATIC DOOR CLOSING ARRANGEMENT

[75] Inventor: Hans Schoker, Vaduz, Liechtenstein

[73] Assignee: Casma Di V. Marinoni & Figli, Magenta, Italy

[21] Appl. No.: 898,140

[22] Filed: Apr. 20, 1978

[51] Int. Cl.[2] ..... E05F 3/00

[52] U.S. Cl. ..... 16/49; 16/66; 16/71; 16/DIG. 9; 16/DIG. 10; 16/DIG. 23; 220/345; 220/351; 248/300; 248/558; 248/674

[58] Field of Search ..... 16/49, 55, 170, DIG. 23, 16/71, 82, 137, 51, 52, 53, 56, 57, 58, 62, 65, 66, 70, DIG. 9, DIG. 10, 558; 248/224.1, 637, 674, 224.2, 311.1 A, 300; 220/241, 242, 345, 351, 353, 356, 376

[56] References Cited

U.S. PATENT DOCUMENTS

| | | | |
|---|---|---|---|
| 3,211,317 | 10/1965 | Patriguin | 292/303 X |
| 3,365,156 | 1/1968 | Beck | 248/224.2 X |
| 3,449,789 | 6/1969 | Russell et al. | 16/49 X |
| 3,742,553 | 7/1973 | Sittmann | 16/49 X |
| 3,787,924 | 1/1974 | Jentsch | 16/49 |
| 4,086,681 | 5/1978 | Nakanishi | 16/49 |

FOREIGN PATENT DOCUMENTS

| | | |
|---|---|---|
| 845548 | 6/1970 | Canada . |
| 2628441 | 12/1977 | Fed. Rep. of Germany . |
| 156351 | 1/1921 | United Kingdom . |

OTHER PUBLICATIONS

Dorma Door Closer, Baubeschlag-Magazin, p. 131, 9/1974.

Trimatic, Baubeschlag-Magazin, p. 132, 9/1974.

Dorma Design TS 73, Thermo-Constant pamphlet.

*Primary Examiner*—C. J. Husar

*Assistant Examiner*—Moshe I. Cohen

*Attorney, Agent, or Firm*—Toren, McGeady and Stanger

[57] ABSTRACT

The closing mechanism of an automatic door closing arrangement is partly enveloped by an elongated unitary casing of sheet metal. Flanges on two of the longitudinal casing walls bound therebetween an opening in the casing which may be closed by a panel releasably retained by the flanges. Provisions are made for attaching the casing to a door and for linking the output element of the closing mechanism to a door frame. The panel may be removed simply and without tools for access to the mechanism or for replacement by another panel of different decorative appearance.

2 Claims, 1 Drawing Figure

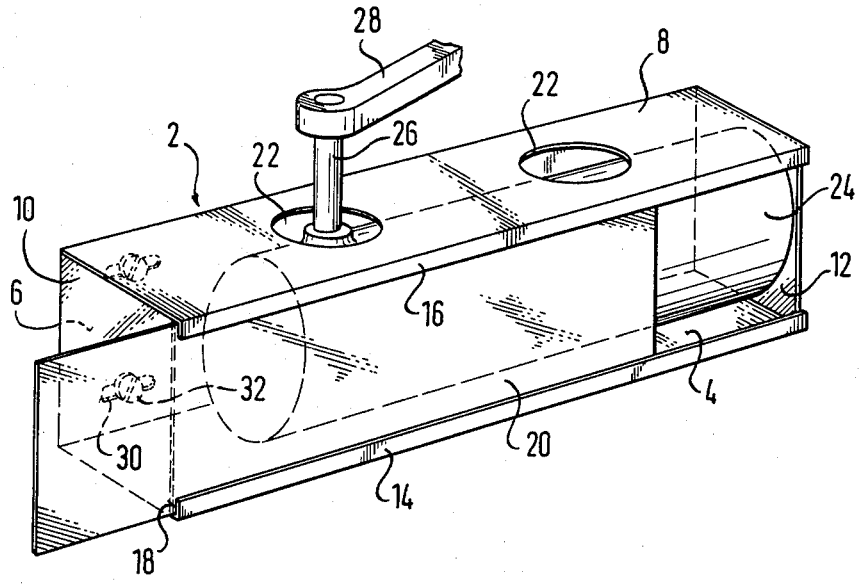
28
8
22
2
22
26
24
10
12
6
16
32
4
30
20
14
18

AUTOMATIC DOOR CLOSING ARRANGEMENT

This invention relates to automatic door closing arrangements, and particularly to a closing arrangement provided with a novel decorative casing.

It is known from U.S. Pat. No. 3,211,317 to enclose the operating elements of a door closing mechanism in a cover capable of being replaced or removed without tools without detaching the closing mechanism from the associated door. The known cover is relatively complex and heavy so that its replacement by another cover entails significant cost and effort. Yet, the cover needs to be removed not only for maintenance access to the operating element of the closing mechanism, but particularly for changes in the decorative appearance of the door and associated elements, as may be required when the door is to be repainted in a different color.

A primary object of the invention is the provision of a closing arrangement of the type described in which access to the principal operating elements of the mechanism and a change in the decorative appearance may be had in an even simpler manner than in the known arrangement.

With this object and others in view, the invention provides a closing arrangement for a door and the like which includes a frame bounding an aperture and a closure member pivotally mounted on the frame for movement toward and away from an aperture-closing position. The arrangement includes a casing elongated in a predetermined direction and including three angularly offset, longitudinal walls fixedly fastened to each other. Two of the walls carry respective, associated, longitudinal flanges which project toward each other from the associated walls and define therebetween an elongated opening in the casing spacedly opposite the third longitudinal wall. Fasteners are provided for fixedly fastening the casing to the closure member. A panel releasably retained by the flanges may slide longitudinally or move otherwise on the casing toward and away from a position in which it closes the opening of the casing. The motor portion of a closing mechanism is arranged in the casing. An output element of the mechanism projects from the motor portion outwardly of the casing and is linked to the door frame in the usual manner.

Other features, additional objects, and many of the attendant advantages of this invention will readily be appreciated as the same becomes better understood by reference to the following detailed description of a preferred embodiment when considered in connection with the appended drawing whose sole FIGURE shows a closing arrangement of the invention in a perspective view.

A prismatic casing 2 of the closing arrangement is a unitary piece of sheet metal respective portions of which form the longitudinal bottom wall 4, rear wall 6 and top wall 8. Approximately square transverse walls 10, 12 are jointed to the rear wall 6 and longitudinally close the casing cavity. A narrow flange 14 rising from the bottom wall 4 and a similar flange 16 depending from the top wall 8 define therebetween an elongated front opening of the casing 2 opposite the rear wall 6. The flanges 14, 16 project slightly beyond the end wall 10 so as to define therewith guide grooves 18 in which a panel 20 is slidably received. Similar guide grooves may be defined between the flanges 14, 16 and the other end wall 12, but are not absolutely necessary. The dimensions of the panel 20 are such that it may close the front opening of the casing 2 when shifted toward the right from the illustrated position.

Two circular openings 22 in the top wall 8, approximately equidistant from the end walls 10, 12 respectively, and the portion of the front opening not covered by the panel 20 reveal a cylindrical motor housing 24 in the casing 2. The housing 24 encloses a pneumatic motor or spring motor conventional in automatic door closing mechanisms and not specifically illustrated whose output shaft 26 passes outward of the casing 2 through one of the openings 22. The shaft 26 may be connected to a door frame by a linkage of which only one element 28 is seen, the linkage being conventional as far as not explicitly illustrated.

The casing 2 is normally fastened near the top edge of the door that it is desired to close automatically by means of wood screws 32 passing through slots 30 in the rear wall 6, only two of the four or more slots and screws being visible in the drawing. The motor housing 24 is attached to the casing 2 by means of machine screws passing upward through openings in the bottom wall 4 in a non-illustrated manner obvious from the showing of the slots 30 and screws 32 and threadedly engaging the housing 24.

While the panel 20 has been shown to be plain or uniformly colored, it may carry an ornamental facing to match the wood grain of the door on which the casing 2 is mounted or the color of the door or to provide any other desired ornamentation. The ornamental appearance of the casing 2 may be changed quickly and simply by sliding the panel longitudinally from behind the retaining flanges and by replacing the panel. Access to the motor portion of the closing mechanism in the housing 20 is similarly available in a very simple manner.

Sheet metal is the preferred material of construction for the panel 20, and a sheet metal panel may be inserted behind the flanges 14, 16 at right angles to its normally exposed face by slightly bending the panel and/or the wall 4, 8. The housing 24 prevents the panel from moving away from the flanges regardless of the manner in which it was inserted.

The illustrated closing arrangement is suitable for right-handed and left-handed doors. The housing 24 with its contents may be reversed in the casing 2 so that the shaft 26 passes through the opening 22 which is idle in the illustrated condition. When it is desired to mount in the casing 2 a closing mechanism in which an output element projects longitudinally from the motor portion, one of the end walls 10, 12 may be omitted or broken away so that the output element may extend outward of the casing in a longitudinal direction.

The illustrated casing is a unitary piece of sheet metal cut and bent into the illustrated shape of a quadratic prism. However, the number of longitudinal walls may be increased if so desired, and the end walls, if any, given a suitable polygonal shape. Molded plastics and diecast zinc alloy casings have been employed heretofore in door closing arrangements, and the casing 2 may be produced by diecasting or by plastic molding without significant change in shape or function.

It should be understood, therefore, that the foregoing disclosure relates only to a preferred embodiment of the invention, and that it is intended to cover all changes and modifications of the example of the invention herein chosen for the purpose of the disclosure which do not constitute departures from the spirit and scope of the invention set forth in the appended claims.

What is claimed is:

1. An automatic door closing assembly particularly adapted to be operatively mounted between a door member and a frame member defining an aperture to be opened and closed by said door member and operating to automatically actuate said door member to the closed position, said assembly being structured to enable selective connection thereof in operative engagement with door members irrespective of the side thereof upon which said door member is hinged to said frame member, said assembly comprising:

an elongated trilateral casing member formed of sheet material having first, second and third integrally joined angularly offset longitudinal walls, with one of a pair of longitudinal flanges extending coextensively with and generally perpendicularly from each of said first and third longitudinal walls, said first and third longitudinal walls from which said flanges extend being located on opposite sides of said casing member with each of said flanges projecting from the associated wall toward the flange on the opposite one of said longitudinal walls;

said flanges defining therebetween an elongated opening spaced opposite to said second longitudinal wall;

a pair of end walls located on opposite ends of said casing member extending transversely to said elongated opening and affixed to said casing member to close the ends thereof;

each of said end walls having edges spaced from each of said pair of flanges to define therebetween guide slots adapted to have a panel member slideably engaged therein for longitudinal sliding movement along said casing member to open and close said opening defined between said pair of flanges;

fastening means for fixedly fastening said casing member to one of said door member and said frame member;

a panel member replaceably fitted within said guide slots between said flanges and said edges of said end walls to close said opening defined between said flanges, said panel member being decoratively arrayed and adapted to be replaced by another panel member to change the decorative effect of said assembly;

an automatic door closing mechanism including a motor portion and an output member projecting from said motor portion and operating to automaticly close said door member when operatively engaged between said door member and said frame member;

mounting means for fixedly mounting said closing mechanism within said casing member, said casing member together with said end walls and said panel member forming a decorative housing for said closing mechanism; and means defining a plurality of openings located at predetermined positions in at least one of said first and said third longitudinal walls of said casing member, each of said openings being sized to permit said output member to project therethrough for operative connection with the other of said door member and said frame member when said closing member is mounted within said decorative housing in any one of a plurality of operative positions;

said mounting means being arranged to selectively enable mounting of said closing member within said decorative housing in any one of a plurality of operative positions depending upon the operating conditions within which said assembly is to be mounted and the particular arrangement whereby said door member is hinged relative to said frame member, said means defining said plurality of openings and said mounting means being cooperatively related to permit said assembly to be adapted for operative mounting between said door member and said frame member in any one of a plurality of said operating conditions.

2. An assembly according to claim 1 wherein said means defining said plurality of openings is arranged to define two openings in one of said first and said third longitudinal walls, said openings being spaced approximately equidistantly from said end walls and permitting said assembly to by mounted in operative engagement between a door member and a frame member for both right-handed doors and left-handed doors.

* * * * *